US006427592B1

(12) United States Patent
Jentzsch et al.

(10) Patent No.: US 6,427,592 B1
(45) Date of Patent: Aug. 6, 2002

(54) METHOD AND APPARATUS FOR FEEDING PRINTING INK TO INKING UNITS OF PRINTING MACHINES

(75) Inventors: Arndt Jentzsch, Coswig; Christian Ziegenbalg, Weinböhla; Bernd Patzelt, Chemnitz; Uwe Becker, Radebeul, all of (DE)

(73) Assignee: Koenig & Bauer AG, Wudzburg (DE)

( * ) Notice: Subject to any disclaimer, the term of this patent is extended or adjusted under 35 U.S.C. 154(b) by 0 days.

(21) Appl. No.: 09/606,908

(22) Filed: Jun. 29, 2000

(30) Foreign Application Priority Data

Jun. 19, 1999 (DE) ..... 199 28 228
Feb. 24, 2000 (DE) ..... 100 09 663

(51) Int. Cl.[7] ..... B41F 31/02

(52) U.S. Cl. ..... 101/365; 101/484

(58) Field of Search ..... 101/364–367, 101/207, 208, 210, 315, 321, 326, 331, 350.1, 351.8, 181, 484, 363

(56) References Cited

U.S. PATENT DOCUMENTS 3,199,451 A * 8/1965 Nitchie ..... 101/366
3,848,529 A * 11/1974 Geglenheimer et al. .... 101/363
4,332,196 A * 6/1982 Braun ..... 101/365
4,787,313 A * 11/1988 Osborn et al. ..... 101/366
5,103,728 A * 4/1992 Barney ..... 101/364
5,265,535 A * 11/1993 Isowa et al. ..... 101/366
5,724,890 A * 3/1998 Deschner et al. ..... 101/366
5,967,049 A * 10/1999 Seymour et al. ..... 101/365
5,967,050 A * 10/1999 Seymour ..... 101/484
5,992,318 A * 11/1999 DiBello et al. ..... 101/181
6,019,041 A * 2/2000 Leonhardt et al. ..... 101/365

* cited by examiner

*Primary Examiner*—Eugene Eickholt
(74) *Attorney, Agent, or Firm*—Goodwin Procter LLP

(57) ABSTRACT

The invention relates to a method for ink supply to ink trays in printing presses, whereby the printing press has for ink supply an ink tray, which is adjoined with an in ball cooperating with ink dosing elements. Task of the invention is to provide a method and an apparatus for zonal ink dosage according to the ink requirements and an extensive residue-free emptied ink tray at job end or job change. The task is solved according the invention by stopping the ink supply before the end of the printing job. This moment is determined so, that a minimum amount of ink sufficient for the to be processed product volume remains in the ink tray at the pre-determined job end and the ink is shifted from ink zones or ink zone groups with lesser ink consumption to ink zones or ink zone groups with momentarily higher ink consumption for processing of the remaining printing job.

16 Claims, 4 Drawing Sheets

METHOD AND APPARATUS FOR FEEDING PRINTING INK TO INKING UNITS OF PRINTING MACHINES

FIELD OF THE INVENTION

The invention relates to a method for ink supply to ink trays in printing presses. The printing press has an ink tray for ink supply. The tray is adjoined by an ink ball cooperating with ink dosing elements, so that ink zones are established for the varying ink supply to the printing matter and the ink consumption is determined for the ink zones or ink zone groups. The data are inputted to and processed in a computer to produce appropriate control signals for local ink consumption at the particular ink zones or ink zone groups, and an ink supply device traverse parallel to the ink ball, thus supplying the ink requiring ink zones or ink zone groups.

The invention also relates to an apparatus in printing presses for ink supply to ink trays by establishing an ink dosing gap between an adjoining ink ball that extends over the entire width and an ink blade that is separated into multiple ink zones. This apparatus also incorporates an ink supply device controlled by a computer for adjusting ink consumption and the ink supply to the ink zones.

BACKGROUND

An apparatus to establish a constant ink level in ink trays of printing presses is known, for example from German patent No. 2,324,452 C2. The constant ink level is adjusted to keep a low printing ink volume in the ink tray. An ink agitator is used for this purpose, traversing along the ink ball. The traversing movement of the agitator creates a wave, which is sensed by a sensor travelling above the ink agitator as a gauge for the ink level. The ink supply is stopped if the ink level is exceeding a preset level. This solution is supposed to guarantee a constant low ink level in the ink tray, but it is not possible to supply the ink to particular ink zones according to the inking requirements.

This problem is supposedly solved with German patent No. 19,512,727 A1 with an ink cartridge that is movable on a slide. A traveling sensor is allocated in the direction of motion before the ink cartridge to detect the ink level in the ink zones. The sensor sends a control signal if the ink level is too low. This causes the release of an appropriate ink volume from the ink cartridge. This solution has the disadvantage that the ink tray cannot be properly emptied at the end of a job. The ink supply takes place according to demand, therefore an uneven surface profile develops with areas of ink accumulation at job end in those areas that have low ink consumption. These ink accumulations cannot be any longer used for printing, and remains in the ink tray of the printing press.

Another device for supplying printing ink is known from German patent No. 4,424,591 C1. A pre-set counter set for the job size is used to empty the ink tray at the end of the job. The pre-set counter is within a circuit with the ink supply. Therefore, the ink supply can be stopped through the ink supply device, by a control signal before the end of the job depending on the number of already printed products. This device also does not enable emptying the ink tray without any residues, due to the uneven surface profile.

BRIEF DESCRIPTION OF THE INVENTION

It is an object of the present invention to provide a method and an apparatus for zonal ink dosage according to the ink requirements with an emptied ink tray at the end of the job or at job change, which is free of extensive residue.

The object is achieved according the present invention by stopping the ink supply before the end of the printing job. This point is determined so that a minimum amount of ink remains in the ink tray at the pre-determined end point of the job that is sufficient to process the required product volume and the ink is shifted from ink zones or ink zone groups with lesser degree of ink consumption to ink zones or ink zone groups with momentarily higher ink consumption for processing and completing the remaining printing job.

The advantage of the solution according to the present invention results in an almost emptied ink tray at the end of the job or at job change. This saves ink and time for manually emptying the ink tray by a pressman.

BRIEF DESCRIPTION OF THE DRAWING

The invention is described below in greater detail by the description of embodiments of the invention, by reference being had to the drawing, wherein.

DETAILED DESCRIPTION

Figure 1:
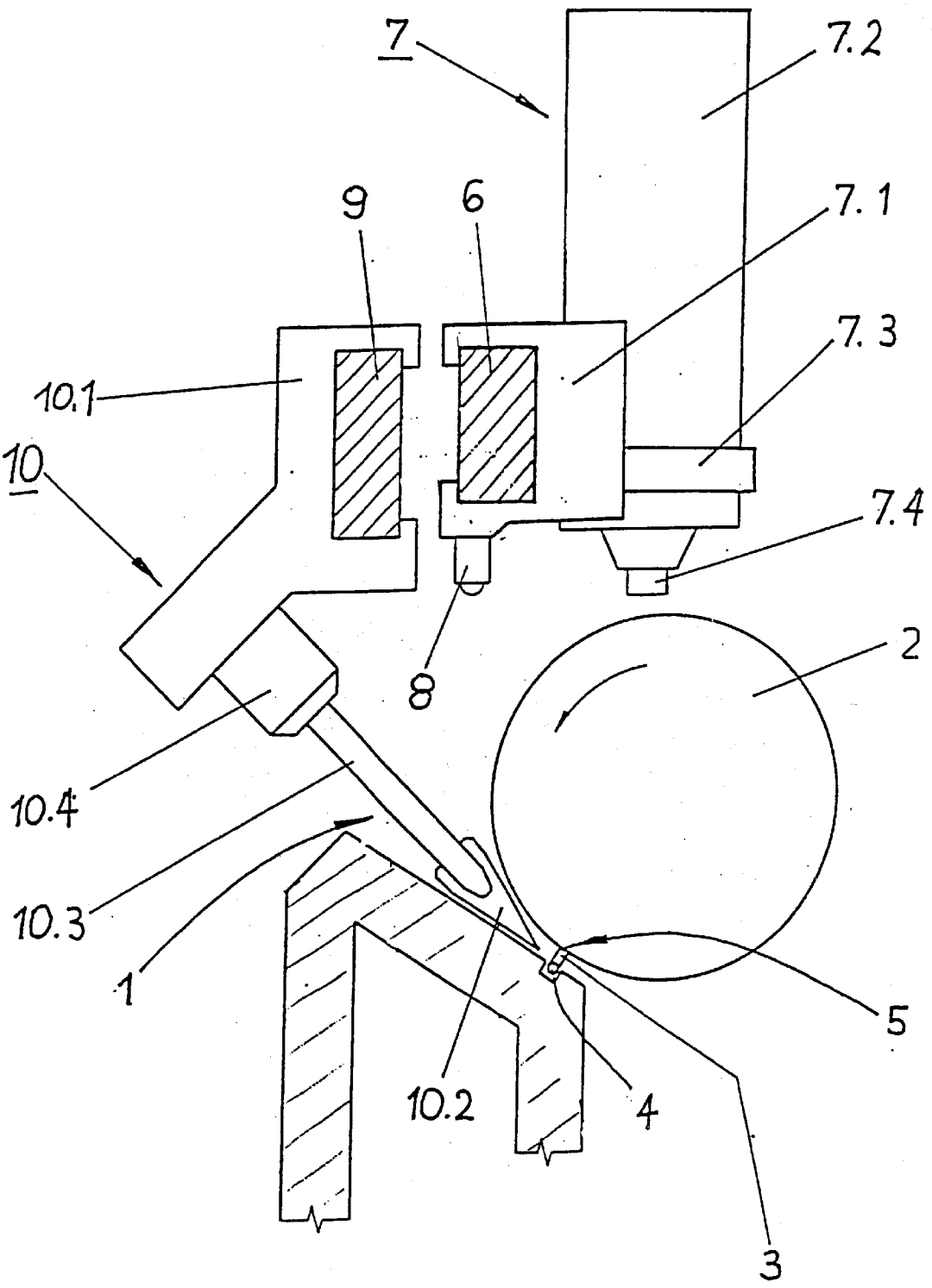
FIG. 1 is a cross-sectional view of one embodiment of the device of the invention, with a traversing ink cartridge as an ink reservoir.
Figure 2:
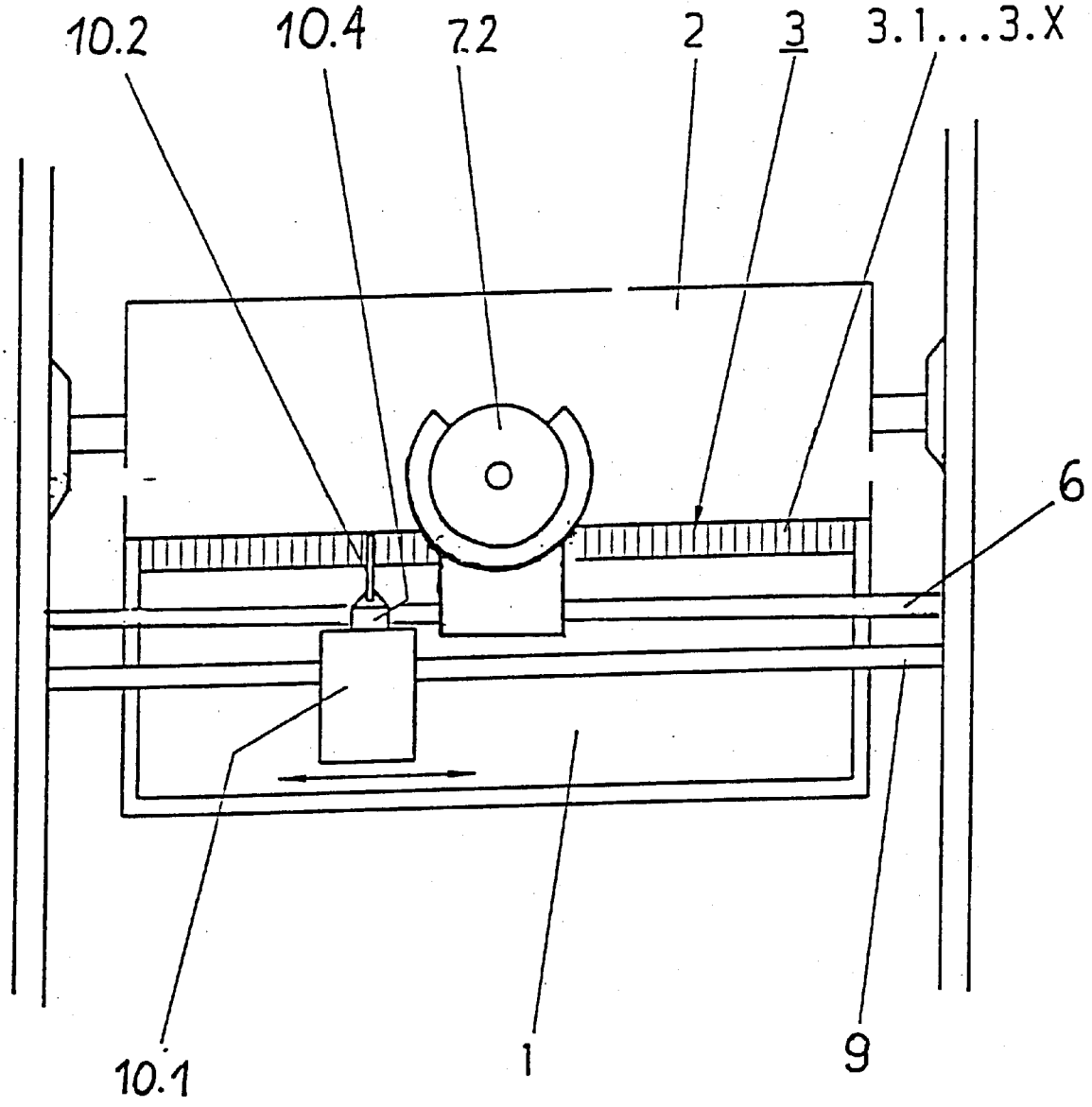
FIG. 2 is a top view of the device of FIG. 1.

FIG. 1 shows a first embodiment of the device having an ink tray 1 with an adjoining ink ball 2. The ink ball 2 extends over the entire width of the ink tray 1 (see FIG. 2). The ink tray 1 carries an ink blade 3 on the side toward the ink ball 2. The ink blade 3 is divided into multiple sections 3.1 . . . 3.x that correspond to the so-called ink zones (see also FIG. 2). Ink dosing elements 4 are allocated at these ink zones, and bring the appropriate sections of the ink blade 3 to a defined distance to the ink ball 2 depending on the ink requirements of the corresponding ink zones, so that a dosing gap 5 is established between the ink blade 3 and the ink ball 2 over its entire length.

A first crossbar 6 is located parallel to the ink ball 2 above the ink tray 1. The first crossbar 6 carries a traveling slide 7.1, of an ink supply device 7, with an ink cartridge 7.2 mounted thereon. The ink cartridge 7.2 has an outlet valve 7.4 that is controlled by a computer (not shown). Constant pressure is produced in the ink cartridge 7.2 by pneumatic or other suitable means (not shown). The ink level in the ink tray 1 is sensed by a sensor 8 allocated at the slide 7.1.

A second crossbar 9 is located at the ink tray 1 and also extends over the entire width of the device and is parallel to the first crossbar 6. The second crossbar 9 carries a traveling slide 10.1 as part of an ink spatula 10. The ink spatula 10 is fixedly mounted from the slide 10.1 and has a receptacle 10.4, a mounting 10.3 and a spatula blade 10.2. The spatula blade 10.2 is so set during ink transport, that minimal gaps are established between spatula blade 10.2 and ink ball 2, and between spatula blade 10.2 and ink tray 1. The mounting 10.3 can be rotated in the receptacle 10.4. The traveling ink supply device 7 and ink spatula 10 are connected to a computer (not shown).

In operation of the above-described device according to the present invention the ink requirement of the individual ink zones is determined by a computer with the data of the running job being inputted. This data is produced either by a plate scanner or by other known pre-press data for the job. Furthermore all press-dependent variable data, e.g. the number of revolutions of the ink ball 2, are permanently determined and fed into the computer; the press-dependent invariable data being stored in the memory of the computer. All these data are processed in the computer and control signals are released to the individual ink zones according to the local ink requirements. It is also possible to allocate multiple ink zones to an ink zone group, which will be treated by the computer like an ink zone.

Ink dosing according to the present invention operates by moving the ink cartridge 7.2 together with the sensor 8 on the first crossbar 6 parallel to the ink ball 2. The sensor determines the ink level of the single ink zones or ink zone groups. If the ink level in the ink tray 1 for a sensed ink zone or ink zone group is too low, a predefined amount of ink is released from the ink cartridge 7.2. The ink is supplied directly to the ink ball 2.

A known kind of counter (not shown) registers the number of products. It counts the printed sheets and feeds the data to the computer. The ink consumption is determined and fed to the computer too. This data enables the computer now to determine the ink consumption per unit of product. The computer can determine from the moment at which a minimum amount of ink will be in the ink tray 1 at the pre-calculated job end sufficient for the still to be printed number of products the known job related data, the press related data and the total number of products. The process of dosing the remaining ink is started when this moment is reached.

At this moment the ink supply from the ink cartridge 7.2 is stopped and a last dosing process is started. The sensor 8 is still active and is traversing the ink tray 1. The ink zones or ink zone groups with lesser ink requirements marked by ink accumulation and the ink zones or ink zone groups with higher ink requirements marked by ink shortage are detected thereby and are fed to the computer.

The ink spatula 10 is activated at the start of the process to dose the remaining ink. As a rule, the ink spatula 10 moves to the location of the biggest ink accumulation and shifts the ink from this ink zone or ink zone group to the ink zone or ink zone group with the current highest ink consumption, to the so-called ink "holes." It is also possible to deviate from this rule for technological reasons, such as when the biggest ink accumulation is far from being the biggest ink "hole." It is very important to supply the ink "holes" according to their demands to prevent local ink deficits and any resulting misprints. This enables maintenance of the job related ink profile almost to the last printed sheet.

The ink spatula 10 is suitably brought out of its operating position if it is moved in the direction to an ink accumulation. It is brought back into its operating position during shifting of the ink. The speed for shifting the ink is lowered by a multiple factor than the speed required to move the ink spatula 10 to its operating position.

Figure 3:
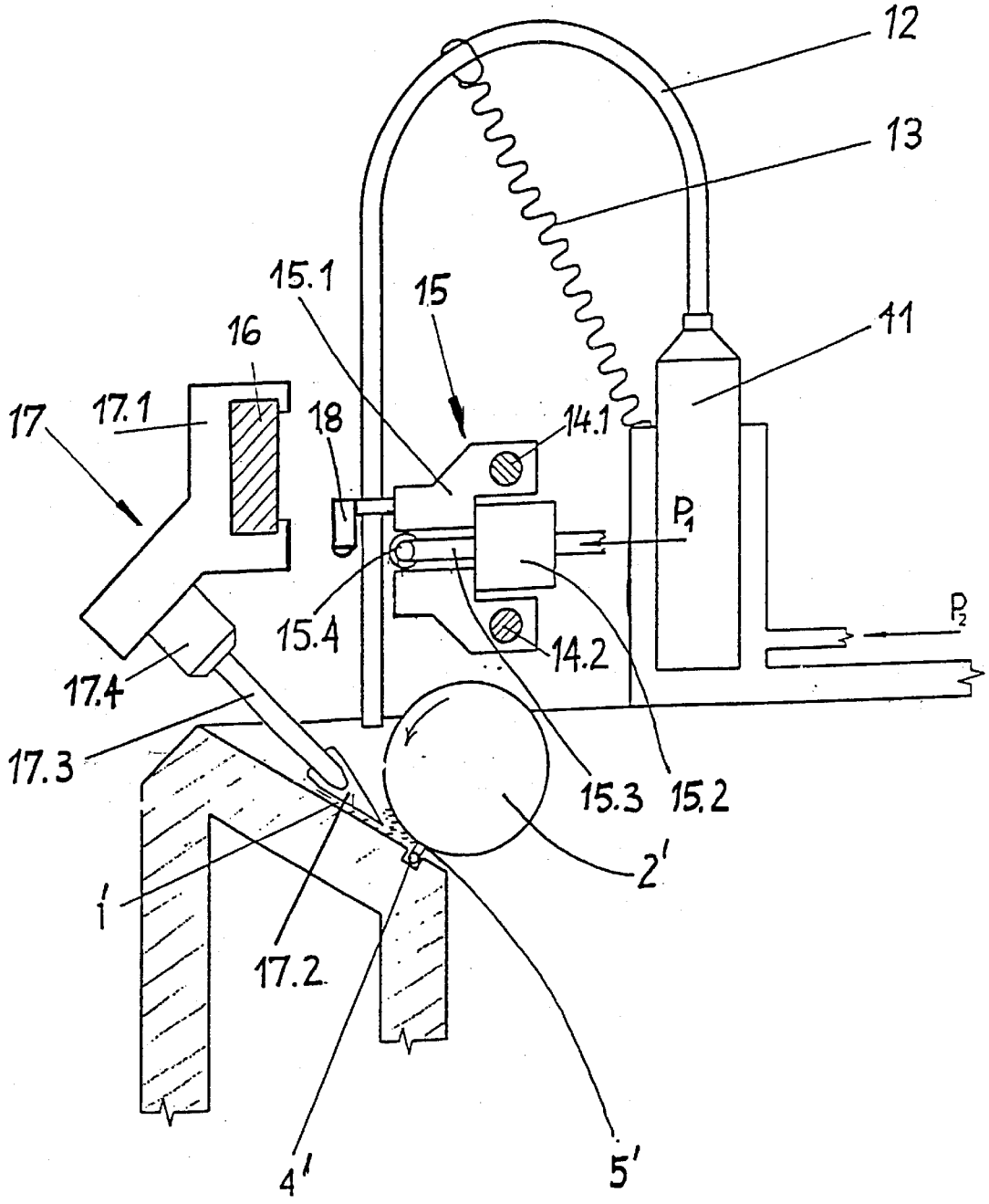
FIG. 3 is a cross-sectional view of another embodiment of the device with a traversing supply hose for ink dosing.
Figure 4:
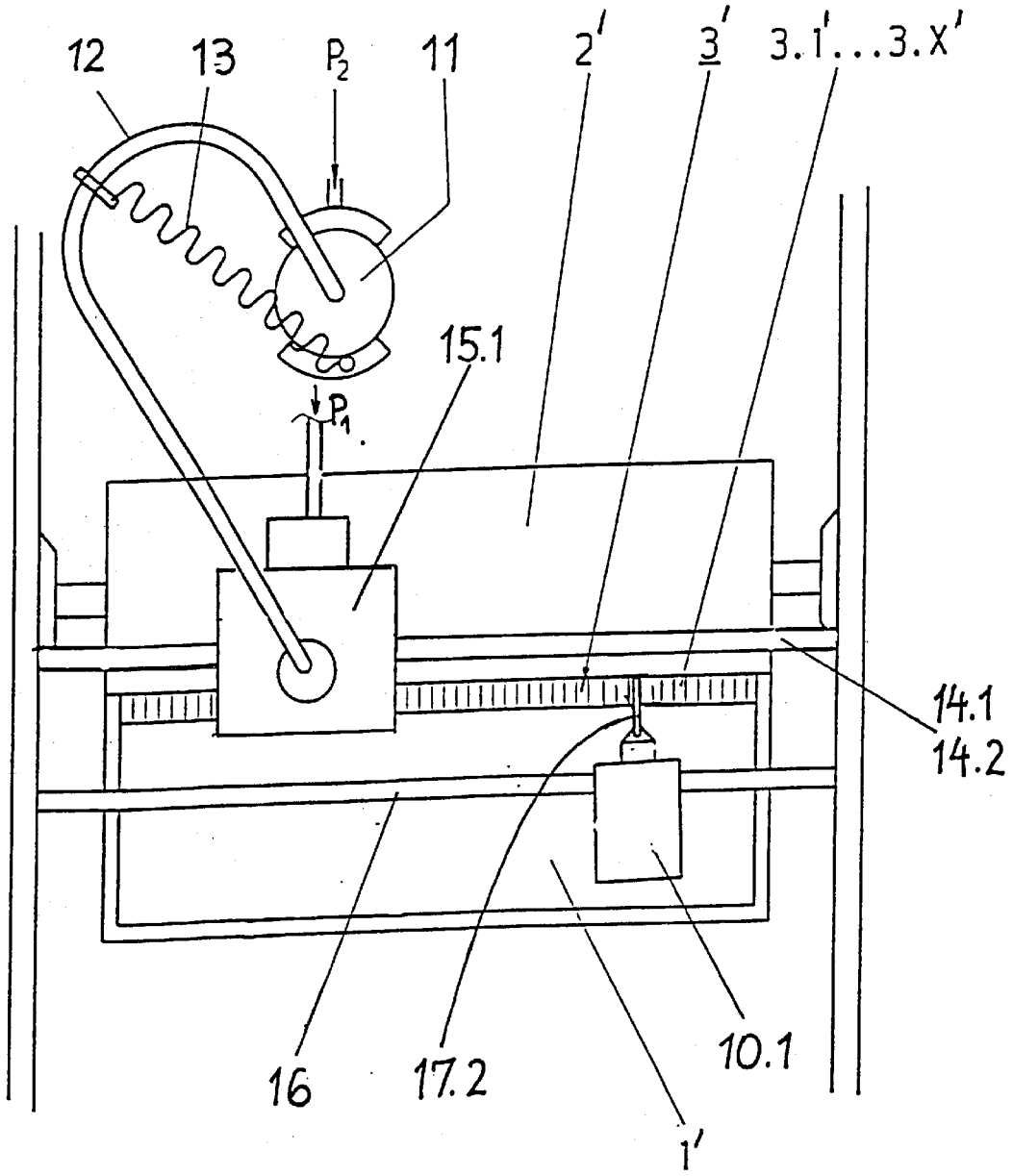
FIG. 4 is a top view of the device of FIG. 3.

FIG. 3 shows another embodiment of the device having an ink tray 1' with an adjoining ink ball 2'. The ink ball 2' extends over the entire width of the ink tray 1'. The ink tray 1' caries an ink blade 3' on the side toward the ink ball 2'. The ink blade 3' is separated into multiple sections 3'x 1 . . . 3'.x, the so-called ink zones (see also FIG. 4). Ink dosing elements 4' are allocated at these ink zones. These are bringing an appropriate section of the ink blade 3' to a defined distance from the ink ball 2' depending on the ink requirements of the corresponding ink zones, so that a dosing gap 5' is established between the ink blade 3' and the ink ball 2' over its entire length.

An ink supply reservoir 11 is affixed to a frame of the printing press (not shown). This affixed mounted ink reservoir 11 is supplied pneumatically with a constant pressure $P_2$.

Two guiding rods 14.1 and 14.2 are disposed above the ink tray 1', and parallel to the ink ball 2'. These two guiding rods 14.1 and 14.2 carry a traveling dosing slide 15.1. The dosing slide 15.1 has the end of a flexible filling hose 12 attached to it. That hose is in operating connection to the interior of the ink reservoir 11. The opening in the end of the filling hose 12 at the dosing slide 15.1 is an ink outlet. Thus the dosing slide 15.1 can move the ink outlet along the ink ball 2'. The filling hose 12 has to be of appropriate length and is supported by spring support 13 to enable its travel.

The dosing slide 15.1 carries a cylinder 15.2 penetrated by a piston rod 15.3. The rod has a pinching roll 15.4. When the cylinder 15.2 receives a pressure $P_1$ the piston rod 15.3 with the pinching roll 15.4 moves against the filling hose 12 and blocks or pinches off the ink supply. The dosing slide 15.1 also carries a traveling sensor 18.

Extending throughout the entire width of the device is a crossbar 16 running parallel to the guiding rods 14.1 and 14.2, and is allocated to the ink tray 1'. The crossbar 16 carries a traveling slide 17.1 with an ink spatula 17. The ink spatula 17 has a receptacle 17.4, a mounting 17.3 and a spatula blade 17.2. The spatula blade 17.2 is set during ink transport so that a minimum gap is established between spatula blade 17.2 and the ink ball 2', as well as between the spatula blade 17.2 and the ink tray 1'. The mounting 17.3 can be rotated in the receptacle 17.4.

The above-described device is connected to a computer (not shown) which controls the traveling filling hose 12 and the ink spatula 17.

The dosing according to the present invention takes place by calculating the ink demand of the single ink keys, analogously to the above-aforementioned first embodiment. The data is processed in the computer and control signals related to the local ink demand are created for the individual ink zones. This enables the device to supply the required amount of ink to each ink zone or ink zone group as required, by moving the dosing slide 15.1 with the end of the filling hose 12 to an appropriate ink zone. In this position the cylinder 15.2 is released and the ink dosing can freely take place. The ink is dosed directly to the rotating ink ball 2'. The cylinder 15.2 is activated again after the dosing process is finished and the pinching roll 15.4 stops further ink supply. Then the next ink demanding ink zone is approached and will supplied according to its ink consumption.

Another application that is not shown, uses a fixed mounted almost pressure-free operated ink reservoir with a squeezing mechanism which takes the required amount of ink from the fixedly mounted ink reservoir and supplies it to the needy ink zone.

The sensor 18 is moved together with the filling hose 12 on the crossbar parallel to the ink ball 2'. This sensor 18 detects the ink level at single ink zones or simultaneously of multiple ink zones gathered in an ink zone group. If the filling level in the ink tray 2' at a sensed ink zone or ink zone group is too low a certain amount of ink is supplied to the needy ink zone. The dosing is made directly at the ink ball 2'.

The further processing takes place analogously to the first embodiment. The printed sheets are counted and their number is transferred to the computer. The ink consumption is simultaneously determined and is also fed to the computer. With this data the computer calculates the ink requirement per product unit. These enable, together with known data stored in the computer, to calculate the moment to stop the ink supply to the ink zones or ink zone groups. The computer can then analogously to the first embodiment estimate the moment at which an ink zone or an ink zone group with the lowest ink requirement does no longer require the supply of ink until the end of the job. If that moment is reached the procedure to dose the remaining ink is started. At this moment the ink supply through the filling hose 12 is stopped and the last distribution of the remaining ink takes place. The sensor 18 continues to be active and permanently traverses along the ink tray 1' and detects ink zone or ink zone groups with he lowest ink and highest ink consumption. The data is fed to the computer.

The ink spatula 10 is activated at the start of the last procedure to distribute the remaining ink for processing the remaining amount of ink as in the first embodiment.

We claim:

1. A method for supplying printing ink to an ink tray in a printing press, the press having an ink tray, an ink ball allocated to the ink tray and ink dosing elements for operating with the ink ball, for establishing ink zones throughout the product to be printed, determining ink consumption data of said ink zones or of groups of said ink zones feeding said ink consumption data into a computer for processing therein to produce a control signal that is proportional to the ink consumption of an ink zone or groups thereof, and an ink supply device traveling parallel to said ink ball for supplying ink to ink zones or ink zone groups in need therefor, and stopping the ink supply before the end of the printing job with the moment which supply of ink is stopped being determined by estimation so that a minimum amount of ink sufficient for the amount of product to be processed to the end of the printing job remains in the ink tray, and shifting ink from ink zones or ink zone groups with lesser ink consumption to ink zones or ink zone groups with momentarily higher ink consumption for the processing of the remaining unprinted products of the print job.

2. The method of claim 1 wherein the amount of product to be printed and the ink consumption therefor are determined during the printing process, the ink consumption per product unit is determined, and the moment is determined for stopping the ink supply to the ink zones or ink zone groups by taking into account the volume of the total number of product to be printed.

3. The method of claim 1, wherein the ink for the amount of the remaining product to be printed is shifted from ink zones or ink zone groups with lesser ink consumption to ink zones or ink zone groups with momentarily higher ink consumption.

4. The method of claim 1, wherein the ink consumption of various ink zones is determined by press and/or job related data, and is fed into a computer.

5. The method of claim 1, wherein job related data are determined by a plate scanner.

6. The method of claim 1, wherein the local ink consumption is determined with job related pre-press data.

7. The method of claim 1, wherein the press speed is sensed as press related data.

8. The method of claim 1, wherein ink is dosed from the ink tray to the ink ball.

9. The method of claim 1, wherein the amount required for ink for supplying the ink zones is provided by a fixedly mounted ink reservoir, and ink is transported through a filling hose having an outlet, to an ink needing ink zone by moving the outlet of the filling hose to said ink zone.

10. The method of claim 9, wherein said fixedly mounted ink reservoir is permanently under pressure.

11. The method of claim 9, wherein ink is dosed by opening and closing the outlet of said filling hose according to the ink demand.

12. The method of claim 9, wherein the ink outlet of said filling hose is closed and the ink reservoir pressure is relieved at the end of the printing job.

13. The method of claim 9, wherein most of the ink remaining at the end of the printing job is transported back to said ink reservoir.

14. The method of claim 1, wherein an ink spatula is used to shift the ink after stopping the ink supply.

15. The method of claim 14, wherein said ink spatula is rotated from or to its operating position depending on the stage of the printing job.

16. The method of claim 14, wherein ink spatula has a return movement, and the speed of said return movement is a multiple of the speed for shifting the ink.

* * * * *